US007766849B2

(12) United States Patent
Nan

(10) Patent No.: US 7,766,849 B2
(45) Date of Patent: Aug. 3, 2010

(54) DISPOSABLE MASSAGE APPARATUS

(75) Inventor: Simon Siu Man Nan, Ontario (CA)

(73) Assignee: Nanma Manufacturing Co., Ltd., Hong Kong (HK)

( * ) Notice: Subject to any disclaimer, the term of this patent is extended or adjusted under 35 U.S.C. 154(b) by 828 days.

(21) Appl. No.: 11/711,212

(22) Filed: Feb. 27, 2007

(65) Prior Publication Data

US 2008/0208085 A1 Aug. 28, 2008

(51) Int. Cl.
*A61H 1/00* (2006.01)

(52) U.S. Cl. ..... 601/70; 601/46; 601/72

(58) Field of Classification Search ..... 601/46, 601/67, 69, 70, 72, 73, 80; 600/38
See application file for complete search history.

(56) References Cited

U.S. PATENT DOCUMENTS

| | | | | |
|---|---|---|---|---|
| 3,375,381 | A * | 3/1968 | Tavel | 601/70 |
| 3,705,578 | A * | 12/1972 | Cutler et al. | 601/73 |
| 2003/0181835 | A1 * | 9/2003 | Klein | 601/72 |
| 2005/0288611 | A1 * | 12/2005 | Fang | 601/70 |
| 2009/0247915 | A1 * | 10/2009 | Imboden et al. | 601/70 |

* cited by examiner

*Primary Examiner*—Quang D Thanh
(74) *Attorney, Agent, or Firm*—Polsinelli Shughart PC

(57) ABSTRACT

A disposable massage apparatus having a massage actuator operatively engaged to a holding member which defines a slot adapted to receive a conductivity blocker that prevents operation of the massage apparatus is disclosed. In operation, the user withdraws the conductivity blocker from the slot in order to make the massage apparatus operational while re-inserting the conductivity blocker into the slot makes the massage apparatus inoperative.

17 Claims, 3 Drawing Sheets

DISPOSABLE MASSAGE APPARATUS

BACKGROUND OF THE INVENTION

The presently described technology generally relates to a massage apparatus, and more particularly to a disposable massage apparatus.

BRIEF SUMMARY OF THE INVENTION

In an embodiment, a disposable massage apparatus may include a disposable massage apparatus having a holding member, the holding member defining a battery compartment adapted to receive at least one battery for providing a power source to the massage apparatus, a massage actuator for providing a vibration massage function, the massage actuator including an actuator casing engaged to the holding member with a slot defined between the holding member and the actuator casing, the massage actuator being in operative association with the at least one battery through an electrical circuit that provides power to the massage actuator from the at least one battery, and a conductivity blocker, the conductivity blocker being adapted to be inserted through the slot for opening the electrical circuit between the at least one battery and the massage actuator and prevent operation of the massage apparatus.

In another embodiment, the disposable massage apparatus may include a disposable massage apparatus having a holding member, the holding member defining a battery compartment adapted to receive at least one battery for providing a power source to the massage apparatus, the holding member defining a slot; a massage actuator for providing a vibration massage function, the massage actuator including an actuator casing engaged to the holding member, the massage actuator being in operative association with the at least one battery through an electrical circuit that provides power to the massage actuator from the at least one battery; and a conductivity blocker, the conductivity blocker being adapted to be inserted into the slot for opening the electrical circuit between the at least one battery and the massage actuator and prevent operation of the massage apparatus.

In yet another embodiment, may include a method of permitting or preventing operation of a massage apparatus including:

a) providing a massage apparatus including a holding member, the holding member defining a battery compartment adapted to receive at least one battery for providing a power source to the massage apparatus; a massage actuator for providing a vibration massage function, the massage actuator including an actuator casing engaged to the holding member with a slot defined between the holding member and the actuator casing, the massage actuator being in operative association with the at least one battery through an electrical circuit that provides power to the massage actuator from the at least one battery; and a conductivity blocker, the conductivity blocker being received through the slot for opening the electrical circuit between the at least one battery and the massage actuator and prevent operation of the massage apparatus; and b) withdrawing the conductivity blocker from the slot such that the electrical circuit becomes closed and permits operation of the massage actuator.

Implementation of the above embodiments may include one or more of the following features:

When the conductivity blocker is removed from the slot the electrical circuit is closed and permits operation of the massage apparatus;

The massage actuator is made operational when the conductivity blocker is removed from the slot and made non-operational when the conductivity blocker is inserted into the slot;

At least one battery includes a positive terminal and a negative terminal in operative association with the electrical circuit;

The massage apparatus is made inoperative when the conductivity blocker is interposed between the positive terminal of the at least one battery and the electrical circuit;

The massage apparatus is made operative when the conductivity blocker is removed from between the positive terminal of the at least one battery and the electrical circuit;

The massage apparatus is made inoperative when the conductivity blocker is interposed between the negative terminal of the at least one battery and the electrical circuit;

The massage apparatus is made operative when the conductivity blocker is removed from between the negative terminal of the at least one battery and the electrical circuit;

The conductivity blocker is made from an electrically insulating material;

The actuator casing defines a plurality of longitudinal ribs;

The massage actuator includes an electric motor, the electric motor including a rotatable motor shaft having an eccentric mass adapted to be spun by the rotatable motor shaft in order to provide the vibration massage function; and/or The electric motor includes a metallic cap in operative association with the electric circuit, the conductivity blocker being interposed between the negative terminal of the at least one battery and metallic cap of the electric motor when the conductivity blocker is inserted into the slot.

Additional objectives, advantages and novel features will be set forth in the description which follows or will become apparent to those skilled in the art upon examination of the drawings and detailed description which follows.

BRIEF DESCRIPTION OF THE DRAWINGS

Corresponding reference characters indicate corresponding elements among the view of the drawings.

DETAILED DESCRIPTION

Figure 1:
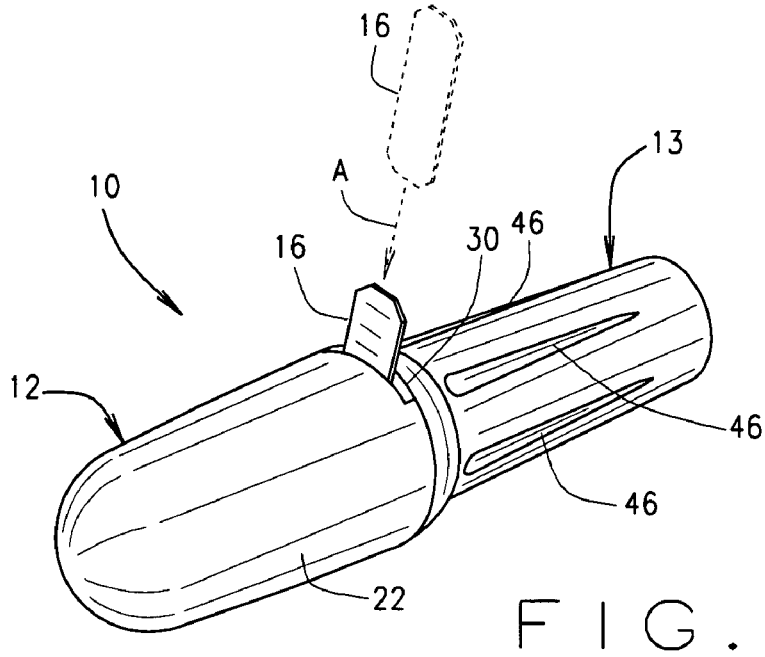
FIG. 1 is a perspective view of a disposable massage apparatus in accordance with an embodiment of the presently described technology.
Figure 2:
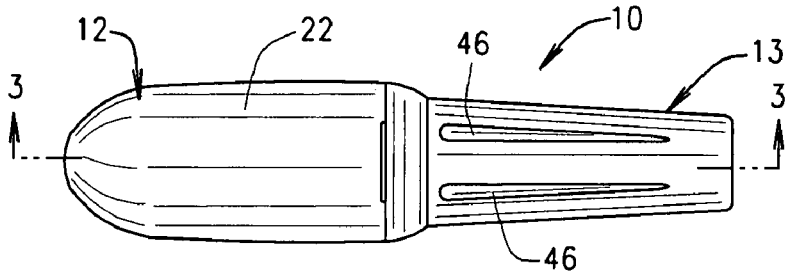
FIG. 2 is a side view of the disposable massage apparatus in accordance with an embodiment of the presently described technology.

Referring to the drawings, a disposable massage apparatus is illustrated and generally indicated as 10 in FIGS. 1-7. In one embodiment, the disposable massage apparatus 10 may include a massage actuator 12 having an actuator casing 22 for providing a vibration massage function. The actuator casing 22 is operatively engaged to a holding member 13 that defines a battery compartment 14 (FIG. 3) for providing power to operate the massage actuator 12 as shall be discussed in greater detail below.

Figure 3:
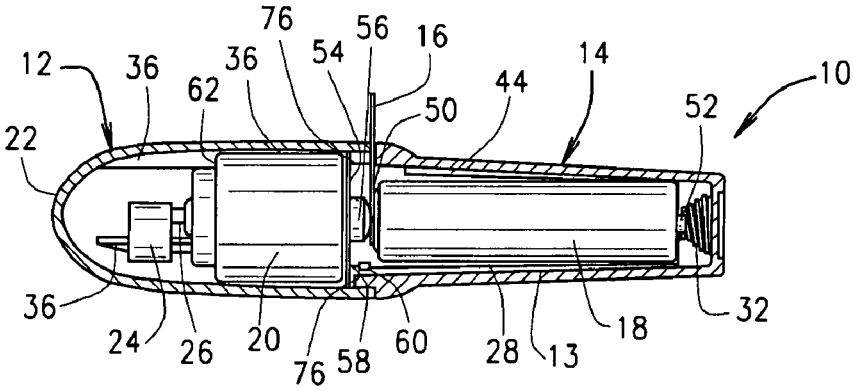
FIG. 3 is a cross-sectional view of the disposable massage apparatus taken along line 3-3 of FIG. 2 in accordance with an embodiment of the presently described technology.

As illustrated in FIGS. 1 and 3, holding member 13 may define a battery compartment 14 adapted to operatively engage a battery 18 having a negative terminal 50 and a positive terminal 52 for connection to an electrical circuit as shall be discussed in greater detail below. In addition, the holding member 13 defines a plurality of longitudinal indentations 46 which provide an ergonomic gripping surface for the user.

Figure 4:
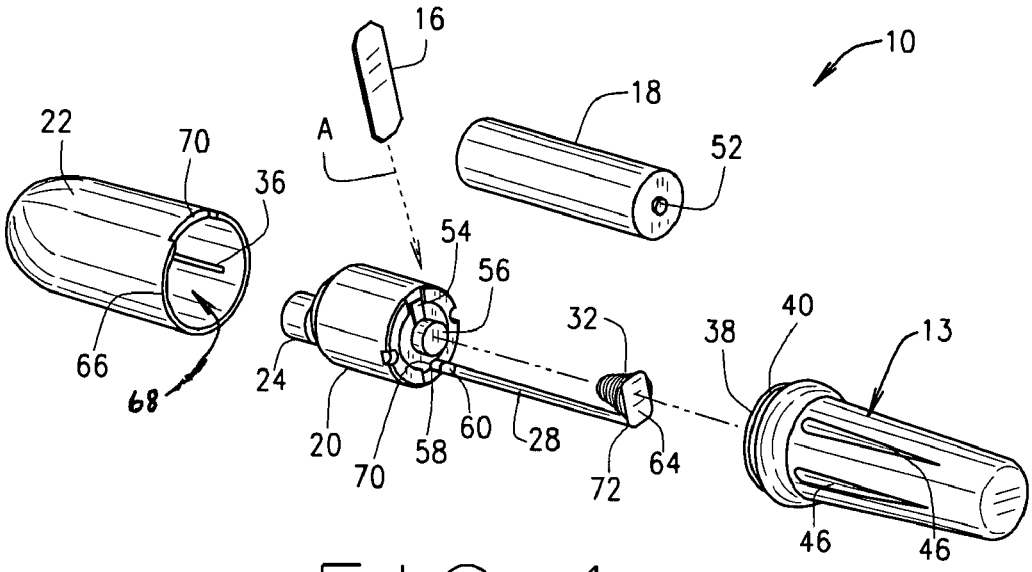
FIG. 4 is an exploded perspective view of the disposable massage apparatus in accordance with an embodiment of the presently described technology.
Figure 5:
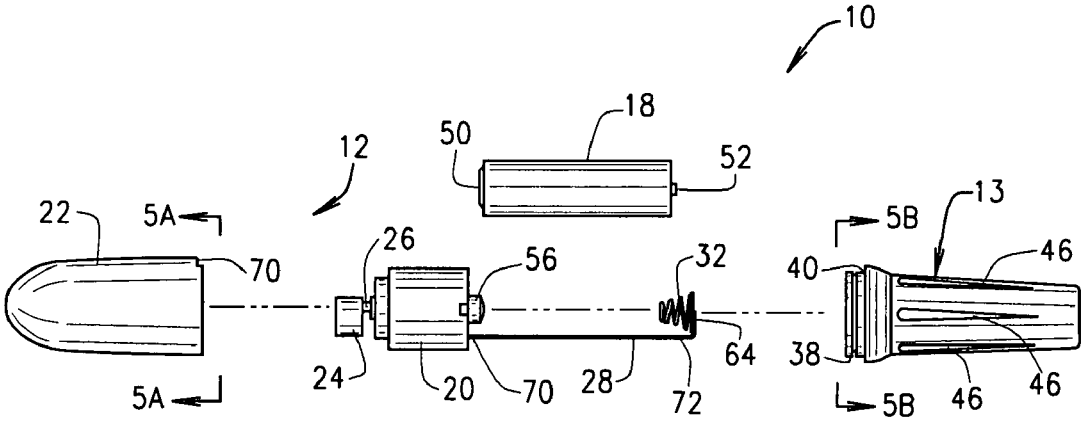
FIG. 5 is another exploded side view of the disposable massage apparatus in accordance with an embodiment of the presently described technology.
Figure 5B:
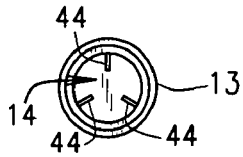
FIG. 5B is another end view of the disposable massage apparatus taken along line 5B-5B of FIG. 5 in accordance with an embodiment of the presently described technology.
Figure 6:
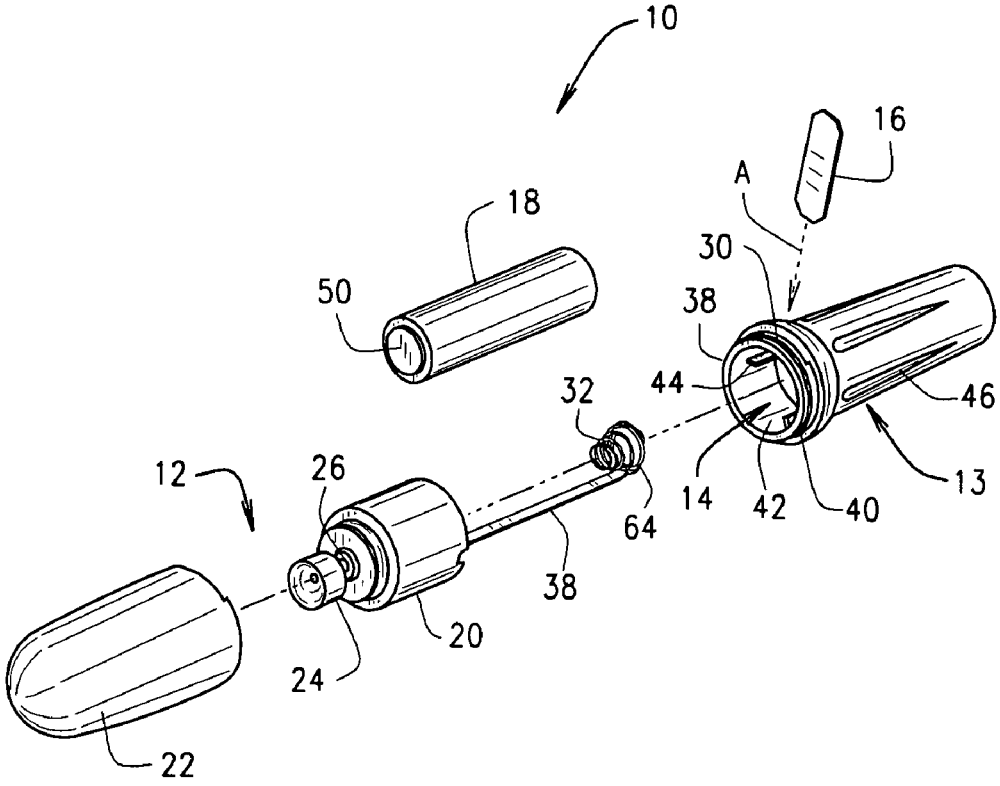
FIG. 6 is another exploded view of an embodiment of the disposable massage apparatus in accordance with an embodiment of the presently described technology.

As shown in FIG. 6, the holding member 13 further defines an opening 42 having a circular boss 38 concentrically surrounded by a circular recess 40, while actuator casing 22 defines an opening 66 in communication with a chamber 68. Referring to FIG. 4, circular boss 38 is adapted to be inserted inside opening 66 in order to engage holding member 13 to actuator casing 22. This engagement secures holding member 13 to actuator casing 22 such that a shoulder 76 may be defined by holding member 13 that is adapted to abut one end of an electric motor 20 and secure the electric motor 20 inside actuator casing 22. As shown in FIG. 5B, the holding member 13 may include a plurality of longitudinal ribs 44 defined along inside portion of the battery compartment 14 which are adapted to secure battery 18 inside holding member 13.

Figure 5A:
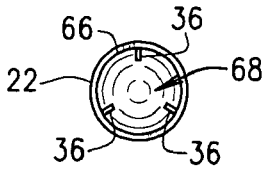
FIG. 5A is an end view of the disposable massage apparatus taken along line 5A-5A of FIG. 5 in accordance with an embodiment of the presently described technology.

Referring to FIGS. 4 and 5A, as noted above opening 66 of actuator casing 22 communicates with an interior chamber 68. Further, opening 66 defines a recess portion 70 that forms a portion of a slot 30 defined between the actuator casing 22 and holding member 13 when the two components are engaged together. In one embodiment, a conductivity blocker 16 may be inserted through slot 30 in order to prevent operation of the disposable massage actuator 10, while removal of the conductivity blocker 16 from slot 30 permits operation of the disposable massage apparatus 10 as shall be explained in greater detail below.

As shown in FIG. 3, the electric motor 20 is disposed inside the interior chamber 68 of actuator casing 22 in order to provide a vibration massage function when disposable massage apparatus 10 is made operational by removal of the conductivity blocker 16 from slot 30. Electric motor 20 may include an eccentric mass 24 mounted on a rotatable motor shaft 26 which spins the eccentric mass 24 when motor shaft 26 is rotated by electric motor 20 to provide the vibration function. As further shown, electric motor 20 includes a metallic pole 58 for operative association with the positive terminal 52 of battery 18 in order to provide power to electric motor 20, and a metallic pole 54 that contacts a metallic cap 56 for operative association with the negative terminal 50 of battery 18.

A plurality of longitudinal ribs 36 is defined along the interior of actuator casing 22 to secure the electric motor 20 inside chamber 68. In one embodiment, three longitudinal ribs 36 are defined along chamber 68 with each rib 36 defining a step 62 for engaging and securing the electric motor 20 inside chamber 68.

As noted above, the electrical circuit of the disposable massage apparatus 10 provides power to the electric motor 20 from the negative and positive terminals 50 and 52 of battery 18. Referring to FIGS. 3 and 5, the electrical circuit may include a metallic conductor 28 having a distal end 72 for operative engagement with the metallic pole 58 of electrical motor 20 and a proximal end 70 for operative engagement with the positive terminal 52 of battery 18. In addition, the electrical circuit may include the operative association between the metallic cap 56 of electrical motor 20 with the negative terminal 50 of battery 18 as discussed above.

As shown in FIG. 4, the proximal end 70 of metallic conductor 28 may be soldered at position 60 such that the metallic conductor 28 is operatively engaged to the metallic pole 58, while the distal end 72 of metallic conductor 28 may define a base 64 adapted to engage a compression spring 32 which may be engaged to the positive terminal 52 of battery 18. This structural arrangement forms the electrical circuit that supplies power between the battery 18 and the electric motor 20.

The conductivity blocker 16 may be made of an electrically insulating material for preventing or permitting operation of the massage apparatus 10. In one embodiment shown in FIG. 6, when the conductivity blocker 16 is inserted in direction A through slot 30 one end of the conductivity blocker 16 is disposed between metallic cap 56 and the negative terminal 50 of battery 18, thereby opening the electrical circuit that prevents operation of the electric motor 20. Conversely, removing the conductivity blocker 16 from slot 30 closes the electrical circuit and permits operation of the electric motor 20.

Figure 7:
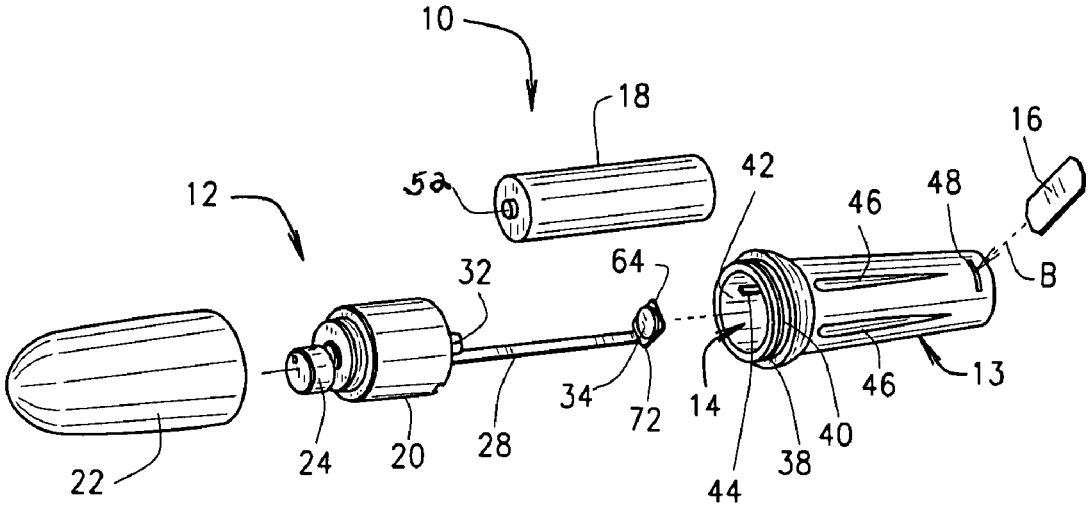
FIG. 7 is an exploded view of another embodiment of the disposable massage apparatus.

Referring to FIG. 7, another embodiment of the massage apparatus 10 is illustrated. In this embodiment, holding member 13 defines a slot 48 adapted to receive conductivity blocker 16 for preventing operation of the massage apparatus 10 by blocking the electrical circuit between the electric motor 20 and the negative terminal 50 of battery 18. In this embodiment, the base 64 of the metallic conductor 28 includes a metallic cap 34 adapted to engage the negative terminal 50 of battery 18 such that power is supplied to the electric motor 20 through the electrical circuit. Insertion of one end of the conductivity blocker 16 into slot 48 in direction B will interpose the conductivity blocker 16 between the metallic cap 34 and the negative terminal 50 of battery 18, thereby opening the electrical circuit and preventing operation of the massage apparatus 10. Similar to the above embodiment, withdrawing the conductivity blocker 16 from slot 48 closes the electrical circuit and permits operation of electric motor 20.

Although the location of the slots 30 and 48 may be different, the insertion of the conductivity blocker 16 through either slot 30 or 48 of the two embodiments will effectively open the electrical circuit and prevent operation of the massage apparatus 10. Accordingly, the electrical circuit may be opened or closed with respect to the negative terminal 50 or positive terminal 52 by inserting or withdrawing the conductivity blocker 16 from either slot 30 or slot 48 depending upon the embodiment of massage apparatus being used.

If desired, the user may dispose of the massage apparatus 10 after use or re-insert the conductivity blocker 16 into either slot 30 or 48 in order to terminate operation of the massage apparatus 10.

It should be understood from the foregoing that, while particular embodiments have been illustrated and described, various modifications can be made thereto without departing from the spirit and scope of the invention as will be apparent to those skilled in the art. Such changes and modifications are within the scope and teaching of this invention as defined in the claims appended hereto.

The invention claimed is:

1. A disposable massage apparatus comprising:

a holding member, said holding member defining a battery compartment adapted to receive at least one battery for providing a power source to the massage apparatus;

a massage actuator for providing a vibration massage function, said massage actuator including an actuator casing engaged to said holding member with a slot defined between said holding member and said actuator casing, said massage actuator being in operative association with said at least one battery through an electrical circuit that provides power to said massage actuator from said at least one battery; and a conductivity blocker, said conductivity blocker being adapted to be inserted through said slot for opening the electrical circuit between said at least one battery and said massage actuator and prevent operation of the massage apparatus.

2. The disposable massage apparatus according to claim 1, wherein when said conductivity blocker is removed from said slot the electrical circuit is closed and permits operation of the massage apparatus.

3. The disposable massage apparatus according to claim 1, wherein said massage actuator is made operational when said conductivity blocker is removed from said slot and made non-operational when said conductivity blocker is inserted into said slot.

4. The disposable massage apparatus according to claim 1, wherein at least one battery includes a positive terminal and a negative terminal in operative association with the electrical circuit.

5. The disposable massage apparatus according to claim 4, wherein said massage apparatus is made inoperative when said conductivity blocker is interposed between said positive terminal of said at least one battery and said electrical circuit.

6. The disposable massage actuator according to claim 4, wherein said massage apparatus is made operative when said conductivity blocker is removed from between said positive terminal of said at least one battery and said electrical circuit.

7. The disposable massage apparatus according to claim 4, wherein said massage apparatus is made inoperative when said conductivity blocker is interposed between said negative terminal of said at least one battery and said electrical circuit.

8. The disposable massage apparatus according to claim 4, wherein said massage apparatus is made operative when said conductivity blocker is removed from between said negative terminal of said at least one battery and said electrical circuit.

9. The disposable massage apparatus according to claim 1, wherein said conductivity blocker is made from an electrically insulating material.

10. The disposable massage apparatus according to claim 1, wherein said actuator casing defines a plurality of longitudinal ribs.

11. The disposable massage apparatus according to claim 1, wherein massage actuator includes an electric motor, said electric motor including a rotatable motor shaft having an eccentric mass adapted to be spun by said rotatable motor shaft in order to provide said vibration massage function.

12. The disposable massage apparatus according to claim 11, wherein said electric motor includes a metallic cap in operative association with the electric circuit, said conductivity blocker being interposed between said negative terminal of said at least one battery and metallic cap of said electric motor when said conductivity blocker is inserted into said slot.

13. A disposable massage apparatus comprising:

a holding member, said holding member defining a battery compartment adapted to receive at least one battery for providing a power source to the massage apparatus, said holding member defining a slot;

a massage actuator for providing a vibration massage function, said massage actuator including an actuator casing engaged to said holding member, said massage actuator being in operative association with said at least one battery through an electrical circuit that provides power to said massage actuator from said at least one battery; and a conductivity blocker, said conductivity blocker being adapted to be inserted into said slot for opening the electrical circuit between said at least one battery and said massage actuator and prevent operation of the massage apparatus.

14. The disposable massage apparatus according to claim 13, wherein when said conductivity blocker is removed from said slot the electrical circuit is closed and permits operation of the massage apparatus.

15. The disposable massage apparatus according to claim 13, wherein said massage actuator is made operational when said conductivity blocker is removed from said slot and made non-operational when said conductivity blocker is inserted into said slot.

16. A method of permitting or preventing operation of a massage apparatus comprising:

a) providing a massage apparatus comprising a holding member, said holding member defining a battery compartment adapted to receive at least one battery for providing a power source to the massage apparatus; a massage actuator for providing a vibration massage function, said massage actuator including an actuator casing engaged to said holding member with a slot defined between said holding member and said actuator casing, said massage actuator being in operative association with said at least one battery through an electrical circuit that provides power to said massage actuator from said at least one battery; and a conductivity blocker, said conductivity blocker being received through said slot for opening the electrical circuit between said at least one battery and said massage actuator and prevent operation of the massage apparatus; and b) withdrawing said conductivity blocker from said slot such that said electrical circuit becomes closed and permits operation of said massage actuator.

17. The method according to claim 16, further including the step of inserting said conductivity blocker into said slot such that said electrical circuit becomes open and prevents operation of said massage actuator.

* * * * *

UNITED STATES PATENT AND TRADEMARK OFFICE

CERTIFICATE OF CORRECTION

PATENT NO. : 7,766,849 B2
APPLICATION NO. : 11/711212
DATED : August 3, 2010
INVENTOR(S) : Simon Siu Man Nan It is certified that error appears in the above-identified patent and that said Letters Patent is hereby corrected as shown below:

Col. 1, line 45: "In yet another embodiment, may include" should read --In yet another embodiment, the disposable massage apparatus may include--

Claim 11, line 2, col. 6: "wherein massage" should read --wherein said massage--

Signed and Sealed this
Thirty-first Day of January, 2012

David J. Kappos

David J. Kappos
*Director of the United States Patent and Trademark Office*